US008025385B2

(12) United States Patent
Jones et al.

(10) Patent No.: US 8,025,385 B2
(45) Date of Patent: Sep. 27, 2011

(54) INK STICKS WITH VISUALLY DISCERNIBLE FEATURE PATTERNS

(75) Inventors: Brent Rodney Jones, Sherwood, OR (US); Christopher Ryan Gold, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 420 days.

(21) Appl. No.: 12/173,842

(22) Filed: Jul. 16, 2008

(65) Prior Publication Data

US 2010/0013898 A1 Jan. 21, 2010

(51) Int. Cl.
*B41J 2/175* (2006.01)

(52) U.S. Cl. ..... 347/99; 347/88

(58) Field of Classification Search ..... 347/88, 347/99

See application file for complete search history.

(56) References Cited

U.S. PATENT DOCUMENTS 5,975,688 A * 11/1999 Kanaya et al. ..... 347/86
6,857,732 B2 2/2005 Jones et al.
6,874,880 B2 4/2005 Jones
6,893,121 B2 5/2005 Jones
7,063,412 B2 6/2006 Jones et al.

* cited by examiner

*Primary Examiner* — Matthew Luu
*Assistant Examiner* — Rut Patel
(74) *Attorney, Agent, or Firm* — Maginot, Moore & Beck LLP

(57) ABSTRACT

A solid ink stick having an ink stick body formed of a phase change ink material. The ink stick body is configured for inclusion in a first set of ink sticks and has substantially a same size and shape as other ink sticks in the first set of ink sticks and ink sticks in a second set of ink sticks. The first set of ink sticks is of a different series than the second set of ink sticks. An identification pattern is formed on the ink stick body. The identification pattern is one identification pattern in a set of identification patterns. The identification pattern formed on the pattern area of the ink stick body is visually discernible from the other identification patterns in the set.

14 Claims, 7 Drawing Sheets

INK STICKS WITH VISUALLY DISCERNIBLE FEATURE PATTERNS

TECHNICAL FIELD

This disclosure relates generally to phase change ink sticks that would be used in compatible ink jet printers.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to a print head for jetting onto a recording medium.

One difficulty faced in solid ink technology is differentiation and identification of ink sticks to ensure the correct loading and compatibility of an ink stick with the imaging device in which it is used. Provisions have been made to ensure that an ink stick is correctly loaded into the intended feed channel and to ensure that the ink stick is compatible with that printer. One such provision is directed toward physically excluding wrong colored or incompatible ink sticks from being inserted into the feed channels of the printer. For example, the correct loading of ink sticks has been accomplished by incorporating keying, alignment and orientation features into the exterior surface of an ink stick. These features are protuberances or indentations that are located in different positions on an ink stick. Corresponding keys or guide elements in the ink loader of the phase change ink printer exclude ink sticks which do not have the appropriate perimeter key elements while ensuring that the ink stick is properly aligned and oriented in the feed channel. Due to the relatively small size of ink sticks, visually recognizable words, numbers or other such identifiers, are correspondingly much smaller so it is generally impractical to apply identifiers more extensive than a logo or color slot symbol on surfaces of the sticks that would be viewed by a user. Manufacturing limitations and ink material robustness vulnerability, such as scrapes, cracking, flaking, chipping and the like, have historically prevented application of such identification on ink sticks.

World markets with various pricing and color table preferences, however, have created a situation where multiple ink types may exist in the market simultaneously with nearly identical size/shape ink and/or ink packaging. Thus, ink sticks may appear to be substantially the same but, in fact, may be intended for different phase change printing systems due to factors such as, for example, ink formulation, service/supplies contracts, market pricing or color table. Due to the broad range of possible ink stick configurations, marketing strategies, pricing, etc., differentiating the inks sticks so only appropriate ink is accepted by a printer requires various ink shapes and physical keying. The resulting proliferation of various different ink stick configurations representing different part numbers or stock keeping unit numbers creates problems of identification since historical stick forms, absent packaging, cannot be easily or accurately deciphered as to intended usage. This situation can arise at locations where multiple product models are in use simultaneously or with bulk storage of unpackaged ink, such as at a manufacturing facility, distribution center or customer site. Unpackaged bulk ink may be an aspect of a waste reduction effort by a supplier or customer. These and similar situations are becoming increasingly significant because of different ink formulations and concurrent sales arrangements or programs in a global market place. Ink sticks with feature sets that can be conveniently translated into useful identification are needed.

SUMMARY

A solid ink stick has been developed that facilitates identification of the ink stick without having to attempt insertion of the ink stick into a printer by utilizing identification patterns formed on the ink stick that may be visually deciphered to determine information pertaining to the ink stick. In particular, a solid ink stick is comprised of an ink stick body formed of a phase change ink material. The ink stick body is configured for inclusion in a first set of ink sticks and has substantially a same size and shape as other ink sticks in the first set of ink sticks and ink sticks in a second set of ink sticks. The first set of ink sticks is of a different series than the second set of ink sticks. An identification pattern is formed on the ink stick body. The identification pattern is one identification pattern in a set of identification patterns. The identification pattern formed on the pattern area of the ink stick body is visually discernible from the other identification patterns in the set.

In another embodiment, a plurality of ink sticks is provided that includes a first set of multi-color ink sticks being of a first series; and a second set of multi-color ink sticks being of a second series. Each ink stick in the first set of ink sticks and the second set of ink sticks is substantially the same size and shape. Each ink stick in the first set of ink sticks and the second set of ink sticks includes a pattern area in the same position on each respective ink stick. The plurality of ink sticks includes a set of identification patterns. Each identification pattern in the set comprises a variation of a pattern that enables each identification pattern to be visually discernible from the other identification patterns in the set. Each identification pattern in the set is assigned to correspond to one of the ink sticks in the first and second sets of ink sticks, and the identification pattern is formed in the pattern area of the corresponding ink stick.

In yet another embodiment, a system for identifying ink sticks is provided. The system comprises a first set of multi-color ink sticks being of a first series; and a second set of multi-color ink sticks being of a second series. Each ink stick in the first set of ink sticks and the second set of ink sticks is substantially a same size and shape. Each ink stick in the first set of ink sticks and the second set of ink sticks includes an identification pattern formed thereon with each identification pattern formed on an ink stick being visually discernible from the identification patterns formed on the other ink sticks. The system includes a matching representation of each of the identification patterns formed on the ink sticks of the first and second sets. The matching representation includes information associated with each identification pattern.

DETAILED DESCRIPTION OF THE PREFERRED EMBODIMENT

Figure 1:
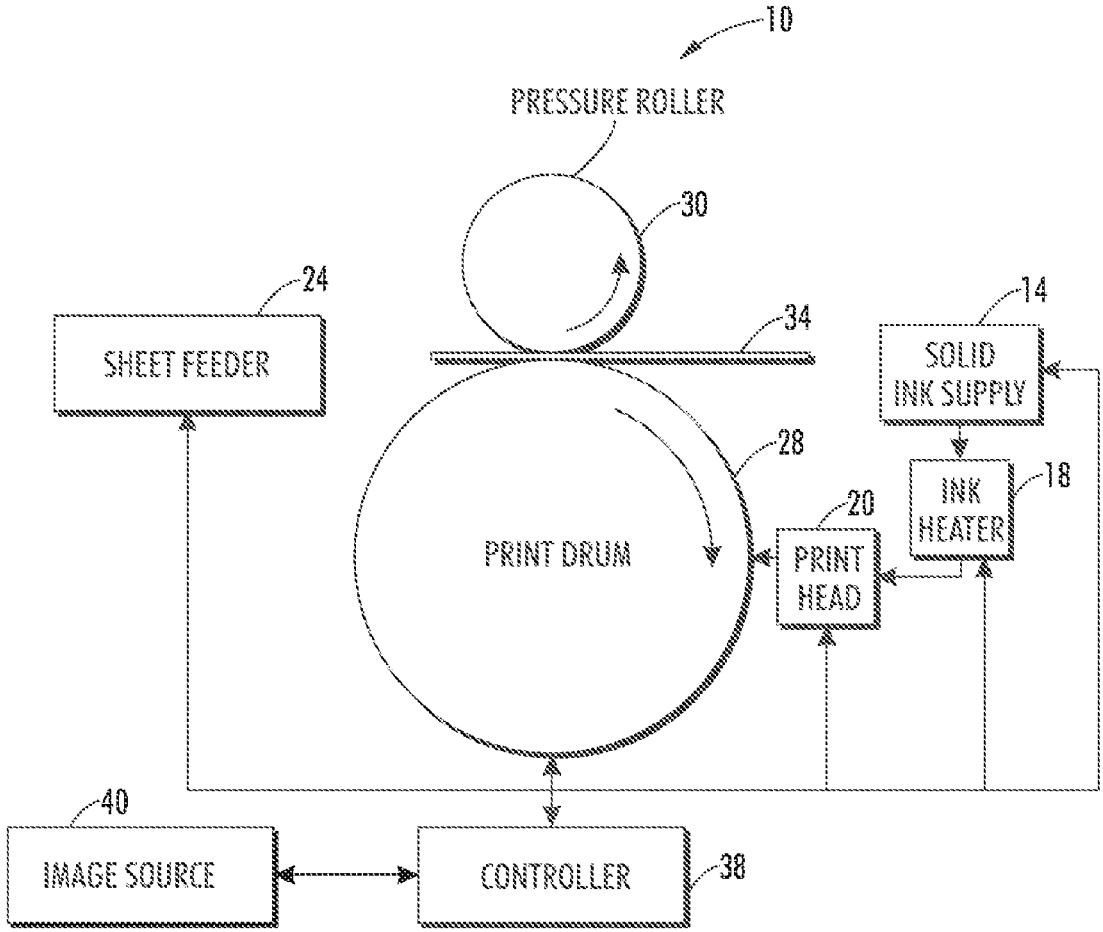
FIG. 1 PRIOR ART
FIG. 1 is a block diagram of a phase change ink imaging device.

For a general understanding of the present embodiments, reference is made to the drawings. In the drawings, like reference numerals have been used throughout to designate like elements. As used herein, the term "printer" refers, to reproduction devices in general, such as printers, facsimile machines, copiers, and related multi-function products; and the term "print job" refers, for example, to information including the electronic item or items to be reproduced. References to ink delivery or transfer from an ink cartridge or housing to a printhead are intended to encompass the range of melters, intermediate connections, tubes, manifolds and/or other components and/or functions that may be involved in a printing system but are not immediately significant to the present disclosure.

Referring now to FIG. 1, there is illustrated a block diagram of an embodiment of a phase change ink imaging device 10. The imaging device 10 has an ink supply 14 which receives and stages solid ink sticks. An ink melt unit 18 heats the ink stick above its melting point to produce liquefied ink. The melted ink is supplied to a printhead assembly 20 by gravity, pump action, or both. The imaging device 10 may be a direct printing device or an offset printing device. In a direct printing device, the ink may be emitted by the print head 20 directly onto the surface of a recording medium.

The embodiment of FIG. 1 shows an indirect, or offset, printing device. In offset printers, the ink is emitted onto a transfer surface 28 that is shown in the form of a drum, but could be in the form of a supported endless belt. To facilitate the image transfer process, a pressure roller 30 presses the media 34 against the ink on the drum 28 to transfer the ink from the drum 28 to the media 34.

Operation and control of the various subsystems, components, and functions of the machine or printer 10 are performed with the aid of a controller 38. The controller 38, for example, may be a micro-controller having a central processor unit (CPU), electronic storage, and a display or user interface (UI). The controller reads, captures, prepares and manages the image data flow between image sources 40, such as a scanner or computer, and imaging systems, such as the printhead assembly 20. The controller 38 is the main multitasking processor for operating and controlling many or all of the other machine subsystems and functions, including the machine's printing operations, and, thus, includes the necessary hardware, software, etc. for controlling these various systems.

Figure 2:
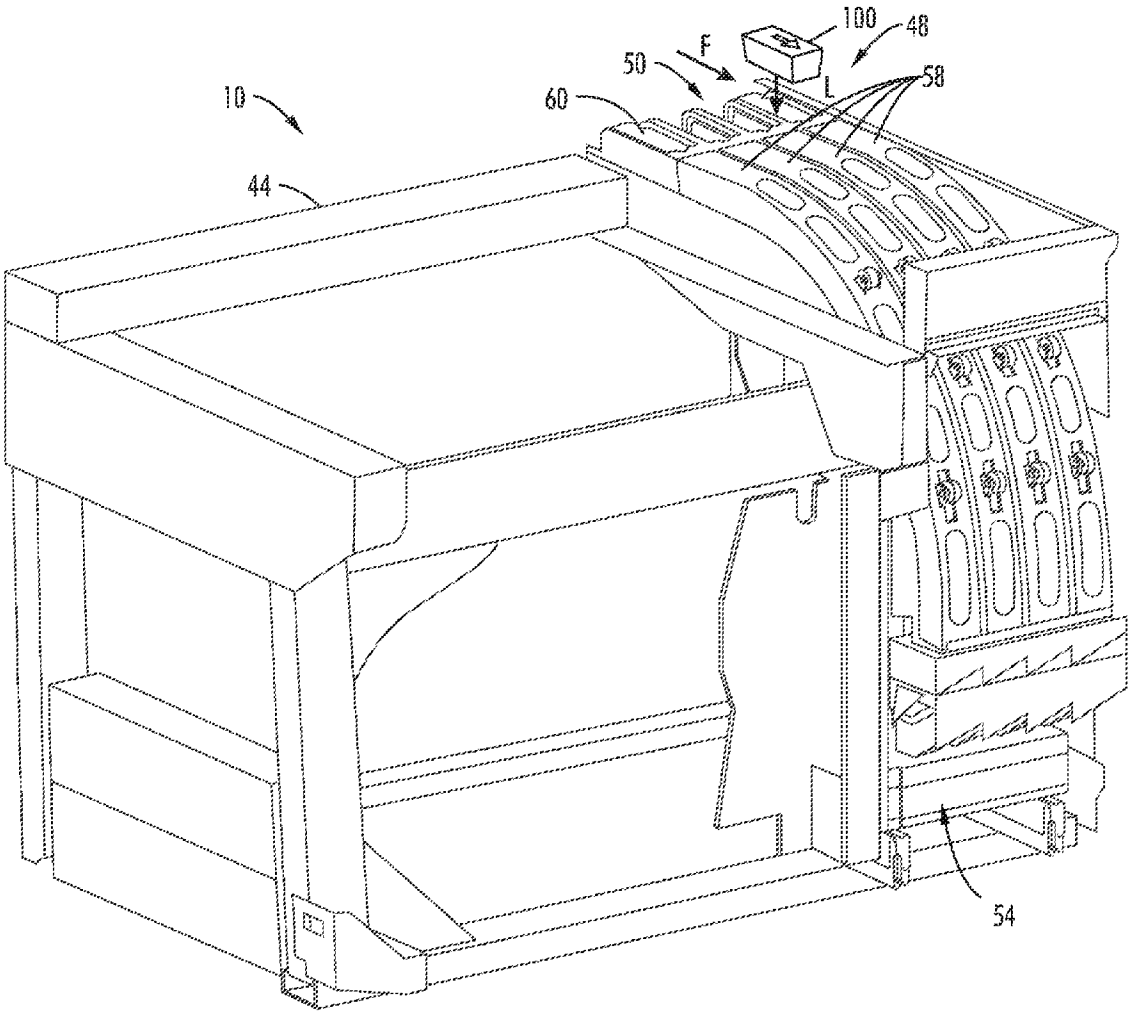
FIG. 2 is an enlarged partial top perspective view of an embodiment of an incomplete phase change ink imaging device with an ink loader.

Referring now to FIG. 2, the device 10 includes a frame 44 to which the operating systems and components are directly or indirectly mounted. A solid ink delivery system 48 advances ink sticks from loading station 50 to a melting station 54. The loading station includes keyed openings 60. Each keyed opening 60 limits access to one of the individual feed channels 58 of the ink delivery system. The keyed openings 60 are configured to accept only those ink sticks having key elements that comport with the key structures of the openings 60. Thus, the keyed openings 60 help limit the ink sticks inserted into a channel to a particular configuration such as color, ink formulation, etc. The ink delivery system 48 includes a plurality of channels, or chutes, 58 for transporting ink sticks from the loading station 60 to the melting station 54. A separate channel 58 is utilized for each of the four colors: namely cyan, magenta, black and yellow. The melting station 54 is configured to melt the solid ink sticks and supply the liquid ink to a printhead system (not shown).

In the embodiment of FIG. 2, the loading station receives ink sticks inserted through the keyed openings 60 in an insertion direction L. The feed channels are configured to transport ink sticks in a feed direction F from the loading station to the melting station. In the embodiment of FIG. 2, the insertion and feed directions L, F are different. For example, ink sticks may be inserted in the insertion direction L and then moved along the feed channel in the feed direction F. In an alternative embodiment, the feed channels and keyed openings may be oriented such that the insertion and feed directions L, F are substantially parallel.

Figure 3:
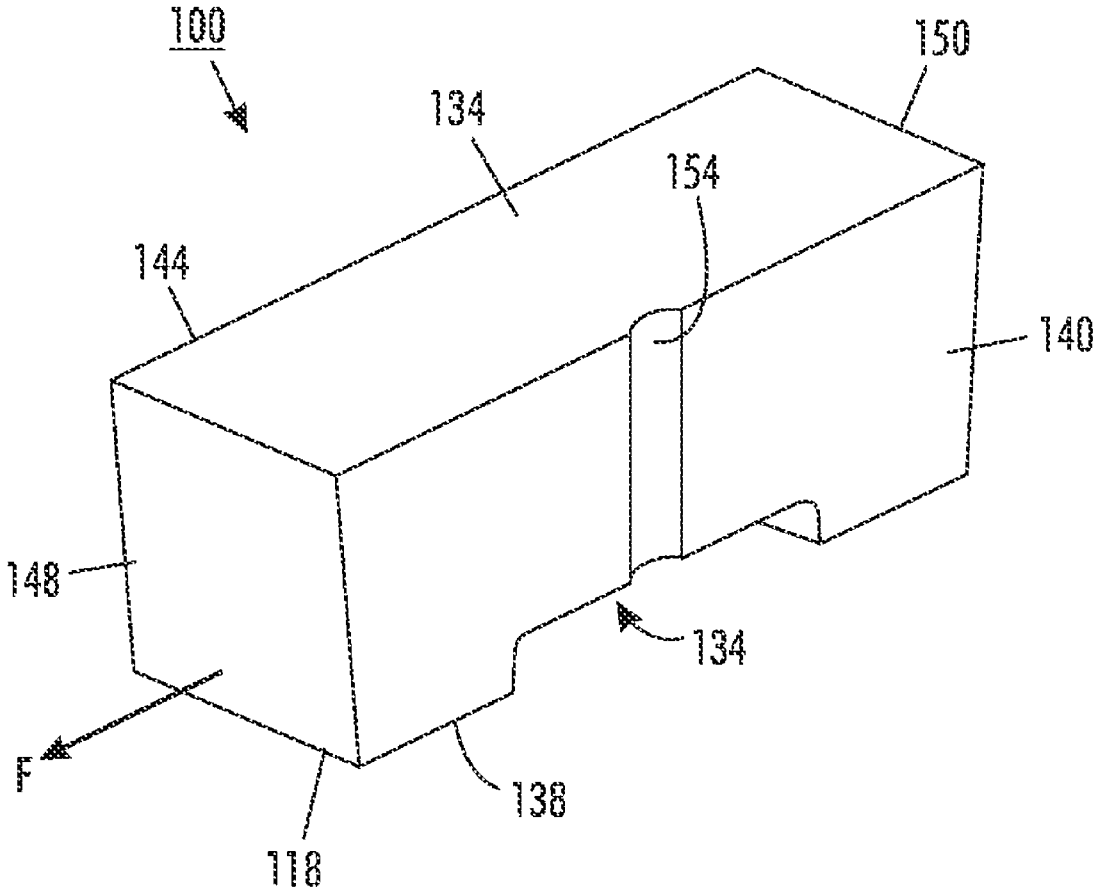
FIG. 3 is a perspective view of one embodiment of a solid ink stick.

An ink stick may take many forms One exemplary solid ink stick 100 for use in the ink delivery system is illustrated in FIG. 3. The ink stick has a bottom surface 138 and a top surface 134. The particular bottom surface 138 and top surface 134 illustrated are substantially parallel one another, although they can take on other contours and relative relationships. Moreover, the surfaces of the ink stick body need not be flat, nor need they be parallel or perpendicular one another. The ink stick body also has a plurality of side extremities, such as lateral side surfaces 140, 144 and end surfaces 148, 150. The side surfaces 140 and 144 are substantially parallel one another, and are substantially perpendicular to the top and bottom surfaces 134, 138. The end surfaces 148, 150 are also basically substantially parallel one another, and substantially perpendicular to the top and bottom surfaces, and to the lateral side surfaces. One of the end surfaces 148 is a leading end surface, and the other end surface 150 is a trailing end surface. The ink stick body may be formed by pour molding, injection molding, compression molding, or other known techniques.

Ink sticks may include a number of features that aid in correct loading, guidance, sensing and support of the ink stick when used. These loading features may comprise protrusions and/or indentations that are located in different positions on an ink stick for interacting with key elements, guides, supports, sensors, etc. located in complementary positions in the ink delivery system. Loading features may be categorized as insertion features or feeding features. Insertion features such as exclusionary keying elements and orientation elements are configured to facilitate correct insertion of ink sticks into the loading station and, as such, are substantially aligned with the insertion direction L of the loading station. As an example, the ink stick of FIG. 3 includes an insertion keying feature 154. The insertion keying feature is configured to interact with the keyed openings 60 of the loading station 50 (FIG. 2) to admit or block insertion of the ink sticks through the insertion opening 60 of the solid ink delivery system. In the ink stick embodiment of FIG. 3, the key element 154 is a vertical recess or notch formed in side surface 140 of the ink stick body substantially parallel to the insertion direction L of the loading station. The corresponding complementary key (not shown) on the perimeter of the keyed opening 60 is a complementary protrusion into the opening 60.

Each color for a printer may have a unique arrangement of one or more key elements in the outer perimeter of the ink stick to form a unique cross-sectional shape for that particular color ink stick. The combination of the keyed openings in the key plate and the keyed shapes of the ink sticks insure that only ink sticks of the proper color are inserted into each feed channel. A set of ink sticks is formed of an ink stick of each color, with a unique key feature arrangement for ink sticks of each color. Insertion keying may also be used to differentiate ink sticks intended for different models of printers. One type of insertion key may be placed in all the keyed openings of feed channels of a particular model printer. Ink sticks intended for that model printer contain a corresponding insertion key element. An insertion key of a different size, shape, or position may be placed in the keyed openings of the feed channels of different model printers. Ink stick descriptions of or similar to "substantially the same shape" are intended to encompass keying and form variations that physically and/or visibly differentiate the sticks of a set or sets from one another but where, absent those one or more features, would appear to be substantially the same shape. Likewise for size even though some mass variation beyond color formulation may be involved.

Although not depicted, the ink stick may include feeding features, such as alignment and guide elements, to aid in aligning and guiding ink sticks as they are moved along the feed channels to reduce the possibility of ink stick jams in the feed channel and to promote optimum engagement of the ink sticks with an ink melter in the ink melt assembly. Feeding features, therefore, may be substantially aligned with the feed direction F of the ink delivery system in order to interact with ink stick guides and/or supports in the ink delivery system. An ink stick may have any suitable number and/or placement of loading (i.e. insertion and/or feeding) features.

in order to increase the ability of a printer control system to gain information pertaining to ink sticks that are utilized in the imaging device, ink sticks may be provided with sensor features for conveying ink stick data, or ink stick identifiers, to the print control system. Sensor features are configured to interact with a sensor system in the ink delivery system to generate one or more signals that correspond to the ink stick identifier(s). An ink stick identifier may comprise one or more values, alphanumeric characters, symbols, etc. that may be associated with a meaning by an imaging device control system. In one embodiment, information may be encoded into an ink stick by selecting at least one unique ink stick identifier to be indicated by the sensor features of an ink stick and implementing an encoding scheme such that the signals generated by sensor features on the ink stick correspond to the ink stick identifier selected. In this way, sensor features may be used to embed information onto the ink stick that identifies the ink stick, such as a serial number, an identification code, or other index mechanism, an origin of the ink stick, ink stick formulation, date of manufacturing, color, part number, stock keeping unit (SKU) number, etc. Ink stick identifiers may be read by an imaging device control system and translated into control and/or attribute information pertaining to the ink stick. For example, the control system may use the ink stick identifier as a lookup key for accessing data stored in a data structure, such as, for example, a database or table. The data stored in the data structure may comprise a plurality of possible identifiers with associated information corresponding to each identifier. It should be noted that a given ink stick configuration, representing a particular ink stick part number, may be used as or designated for multiple stock keeping unit (SKU) numbers, as example, in a package of one stick or a package of four sticks or in unpackaged bulk, where each are inventoried and sold independently.

While the use of keying and sensor features on ink sticks may be effective in ensuring that ink sticks are correctly loaded and compatible with the printer in which they are used, the use of keying and sensor features is limited in that the identification or authentication of an ink stick cannot be done without attempting to insert an ink stick into the printer to see if the keying features on the ink stick match the keying features of an insertion opening of the ink loader or to see if sensor features on an ink stick indicate to the control system that the ink stick is compatible with the printer.

In order to provide an inventory person or a printer operator with a visual identification means that facilitates identification and differentiation of ink sticks without having to attempt insertion of the ink stick into the printer, ink sticks may be provided with visually recognizable or readable markings either on a surface of the ink stick or as the shape of the ink stick itself. Visual markings typically legible and thus meaningful would consist of numbers and/or letters and may include part numbers, stock keeping unit (SKU) designations, or other form of textual markings that may be imprinted, stamped, etched, laser cut, etc. into a surface of an ink stick and that may be read by a printer operator to identify an ink stick. Due to the wide range of possible ink stick configurations, ink stick SKU's, part numbers, etc., however, providing each ink stick configuration, SKU, or part number with a separate unique identifier may increase the complexity and cost of manufacturing ink sticks. For example, the different marking devices and/or methods required to provide unique markings for all manufactured ink sticks may be expensive and add steps to the manufacturing process. Feature size, material robustness vulnerability and the limitations of ink material may make such marking impractical or impossible.

As an alternative to marking or imprinting ink sticks with different part numbers, SKU's, etc., a method for visually identifying ink sticks has been developed that utilizes visually discernible identification patterns incorporated into one or more surfaces of an ink stick that allow ink sticks to be uniquely identified visually. For purposes of the present specification and claims, the term "visually discernible" is to be construed in terms of an unaided or naked human eye. Identification patterns are formed of one or more surface features, or elements. The pattern elements that make up the patterns advantageously have geometry that is capable of being easily formed or incorporated and visually discernible without magnification. For example, the elements that make up the patterns may be protrusions, depressions, steps, insets, slopes and combinations that may comprise, in all or in part, variation in size, orientation, mirror images, angles, etc. In addition, pattern elements of the pattern may be round, square, or any suitable shape, have radiuses, ellipsis, angles, etc. Pattern elements such as these are relatively simplistic in form and may be easily incorporated into ink sticks formed or manufactured by various techniques, such as pour molding or injection molding. Such features may be formed with tooling inserts that are movable in the tooling and thus may eliminate the need for full tool or insert replacement when reconfiguring the molding tool for different ink stick types or configurations.

In addition, by utilizing patterns that are made up of features that are simplistic in form, sets of identification patterns may be devised that are substantially similar, for example, by using similarly sized and shaped pattern elements for each pattern in a set of patterns. A set of unique identification patterns may be generated from a substantially equivalent set of patterns by varying, in a visually discernible or detectable manner, the placement, number, size, shape, etc. of one or more of the pattern elements in each pattern so that each identification pattern in a set of related patterns is different from every other pattern in the set. Slight variations from pattern to pattern in a set allows each different ink stick configuration to be formed or manufactured with a unique identification pattern with only a slight or minimal modification to the tooling or process used to form the unique identification pattern from ink type to ink type or even from ink stick to ink stick.

A set of related identification patterns may be associated with a particular ink stick set, type or configuration where the ink set includes multiple ink sticks that may be otherwise identical in form but includes unique colors, ink formulation, compatibility with a specific printer model or platform, different marketing programs, different geographic distribution areas, etc. A different unique identification pattern in a set of related identification patterns may be assigned to correspond to each ink stick in an ink set in order to differentiate the ink sticks in the set, for example, by at least one of color, formulation, printer compatibility, marketing program, and distribution area. Substantially any information pertaining to an ink stick or to the printer in which it is to be used may be associated with identification patterns by assigning a particular identification pattern to correspond to ink stick information such as the appropriate insertion opening for the ink stick, an alpha and/or numeric designation, such as a part number, SKU, or other unique identifier, the product model, printer platform or series that the ink is compatible with, etc. Information pertaining to a particular ink stick may then be embedded in the ink stick by selecting the appropriate identification pattern and forming the pattern in a predetermined location on the ink stick.

FIGS. 4*a*-4*d* show an embodiment of how a set of ink sticks 100*a*-100*d* may be differentiated by a set of related identification patterns 200*a*-200*d*. In this embodiment, the identification pattern 200 on each ink stick 100 is related in that each pattern is made of the same number of pattern elements 204, in this case four, and each pattern element 204 of each identification pattern 200 has substantially the same size and shape. In FIG. 4, the pattern elements comprise substantially square insets or steps formed in the bottom surface of the ink sticks although the elements may be any suitable shape and may be protruding, stepped, angled, etc.

Figure 4:
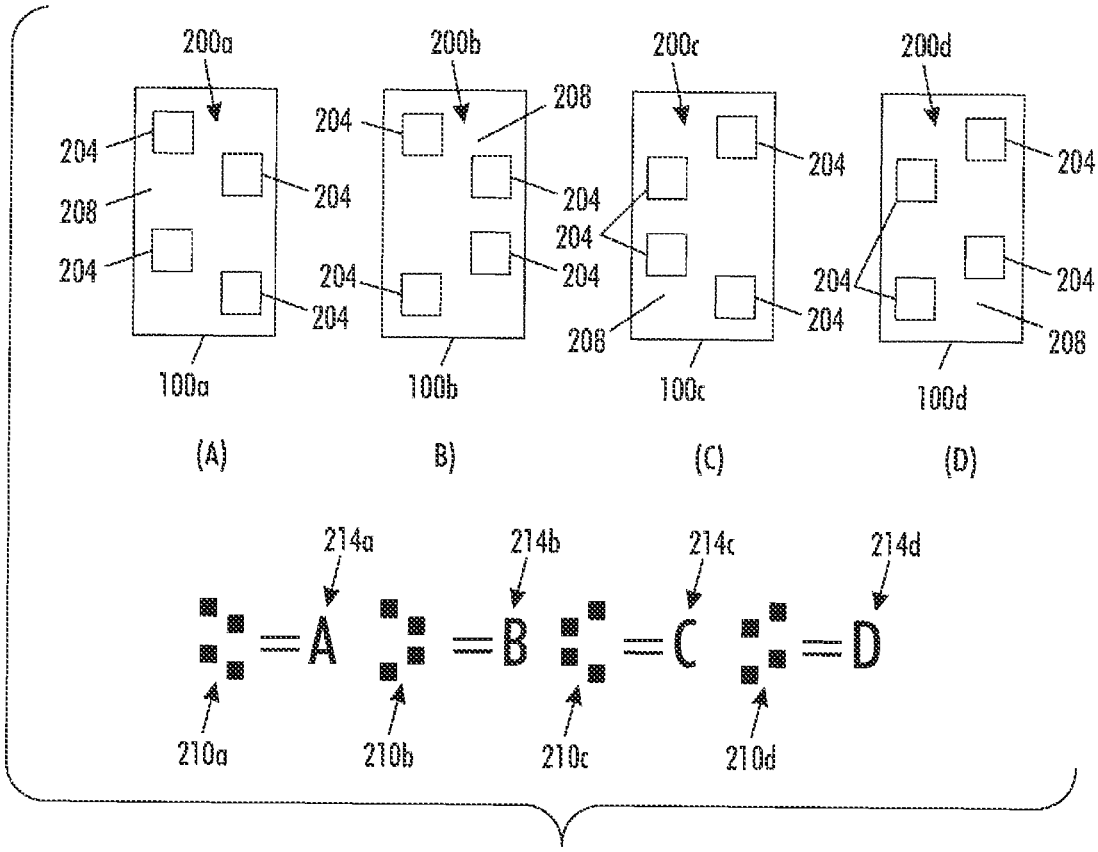
FIGS. 4*a*-4*d* are elevational views of ink sticks having variations of an identification pattern.

There are four ink sticks depicted in FIG. 4. For the sake of discussion, each ink stick of FIG. 4 may be considered to be of a different configuration. For example, the ink sticks of FIG. 4 may be different color ink sticks of a multi-color ink set. Alternatively, the ink sticks may each be of the same or different color of ink but be intended for a different printing platform, marketing program, price point, geographic distribution area, etc. Each ink stick in FIG. 4 includes a pattern area 208 which is to receive an appropriate or pre-selected identification pattern corresponding to each respective ink stick. Pattern areas may be on substantially any surface of an ink stick and, in some cases, may be on more than one surface or one or more pattern surfaces may be separated or interrupted by an ink stick feature that is not an element of the pattern. The term "multi-color ink sets" and related descriptions includes sets, such as the common cyan, magenta, yellow and black but also includes sets with subtle "color" differences, such as black and various shades of gray or even clear. Sets of differing "color" may comprise as few as two sticks or more than four though four has been most common.

As can be seen in the embodiment of FIG. 4, variations in the set of identification patterns 200*a*-200*d* are implemented by varying the placement of the pattern elements 204 within the pattern area 208 of each ink stick so that each ink stick includes a unique identification pattern relative to the other identification patterns in the set. For the purpose of this discussion, the pattern areas of the ink sticks in FIG. 4 include a first end and a second end that may or may not correspond to the ends or sides of an ink stick. In FIG. 4, the placement of the pattern elements in each pattern is varied by varying the offset placement of the pattern elements relative to one another and/or an end of the inks sticks. pattern elements may be fully or partially offset and may be laterally adjacent or separated from each other. The number of unique identification patterns in the set of identification patterns of FIG. 4, or in substantially any other such identification pattern, may be expanded in a number of ways such as by including patterns that have voids at select positions within the pattern, allowing side by side as well as offset pattern elements, varying the shape of one or more pattern elements in select patterns, including one or more additional pattern elements in select patterns, etc. Pattern elements may be truncated by or intruded into by other features, such as a guide or key feature, where such features are likely to be ignored or factored out of an identification interpretation. Nominal pattern element shapes may have to be altered in some locations to improve robustness or aesthetics of the ink stick, extending through, rounding or chamfering an outside edge, as example.

Information may be associated with the identification patterns depicted in FIG. 4 by assigning each pattern to correspond to substantially any information that may be desired to be associated with a particular ink stick, ink stick configuration, operation parameters, etc. For example, as depicted in FIG. 4, the identification pattern 200*a* may be associated with the value A, pattern 200*b* may be associated with value B, pattern 200*c* may be associated with value C, and pattern 200*d* may be associated with the value D. The values A, B, C, and D may be equivalent to or correspond to information such as ink stick color where A=cyan, B=magenta, C=yellow, and D=black. Cyan ink sticks may then be imprinted with or formed with the pattern 200*a* as depicted on ink stick 100*a*, magenta ink sticks may be formed with the pattern depicted on ink stick 100*b*, etc, An printer operator may then be able to visually inspect the pattern on an ink stick and determine the color of ink stick based on the particular pattern on the ink stick. This may be accomplished by comparing an unidentified ink stick pattern to a known configuration of ink stick having a known representation of the pattern. Alternatively, the information embedded in the pattern may be deciphered by comparing the unidentified pattern to visual representations 210 of the patterns that includes the information 214 associated with each pattern such as those depicted in the lower portion of FIG. 4. The values A, B, C and D, of course, may correspond to or be replaced by any suitable data or information such as SKU, part number, printer model, etc.

Figure 5:
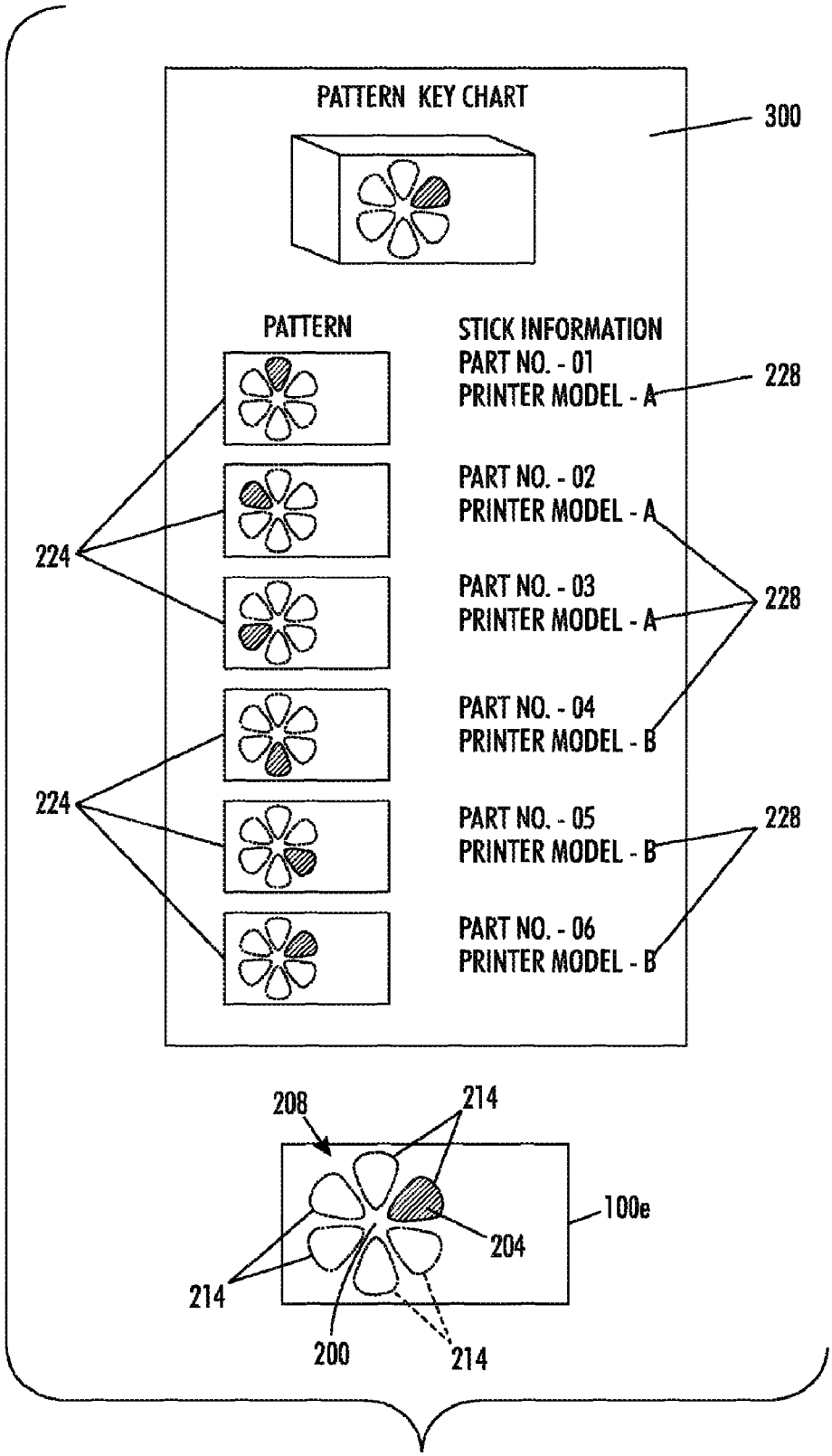
FIG. 5 shows another embodiment of an identification pattern that may be incorporated into an ink stick and an accompanying pattern key chart for identifying the pattern.
Figure 6:
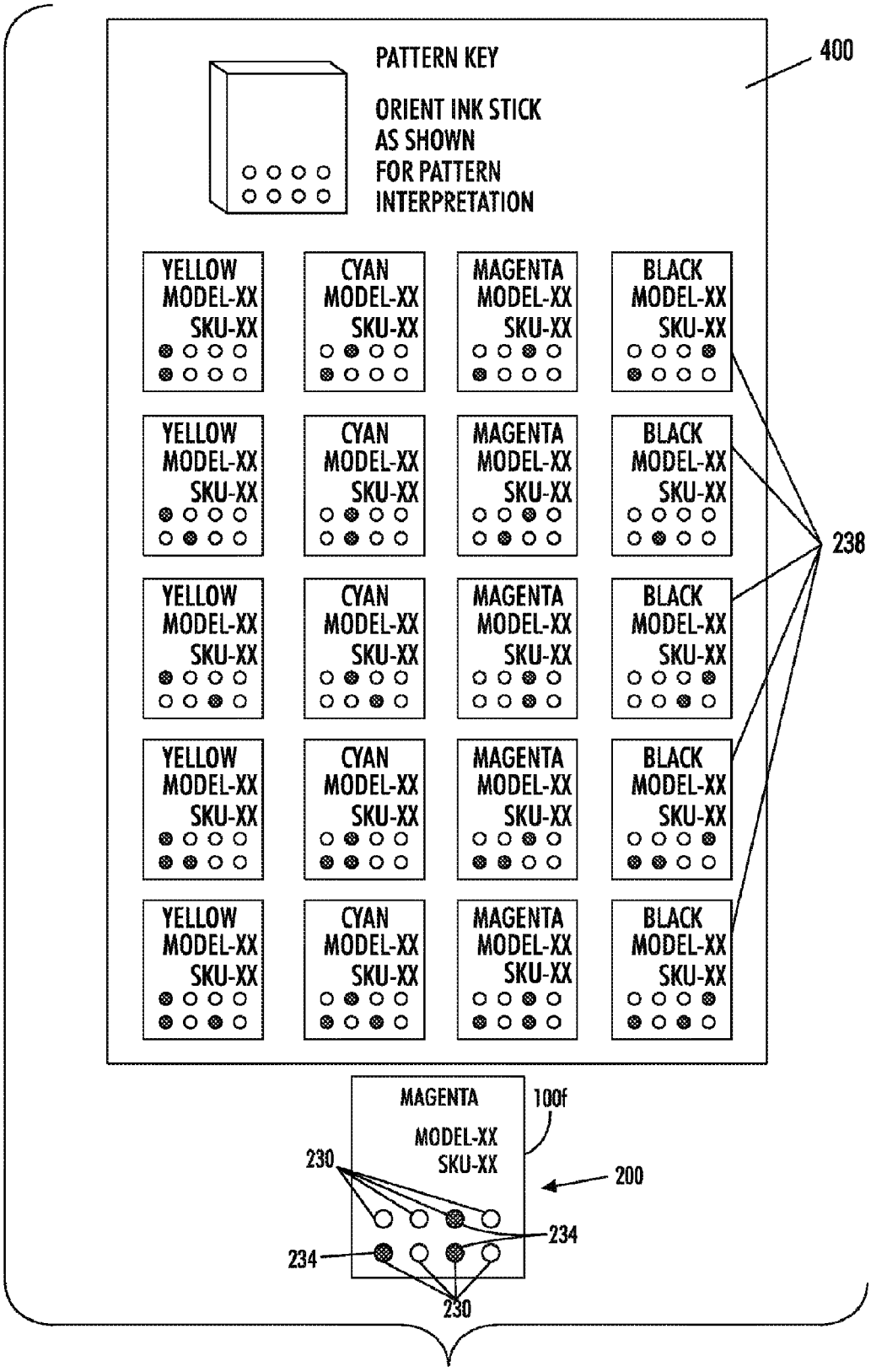
FIG. 6 shows another embodiment of an identification pattern that may be incorporated into an ink stick and an accompanying pattern key chart for identifying the pattern.

Referring now to FIG. 5, there is shown another embodiment of how to pattern differentiate ink sticks. In this embodiment, the pattern area 208 of ink stick 100*e* includes a plurality of potential element locations 214 within the pattern that are the substantially the same for each potential pattern. The identification patterns may be varied from pattern to pattern within a set of patterns by varying the potential locations 214 in each pattern that receive pattern elements 204 and/or the number of locations that receive pattern elements. In the embodiment of FIG. 5, the pattern 200 comprises a flower shape that includes a plurality of potential pattern element locations 214, in this case six, that are arranged and shaped similar to the pedals of a flower. The flower pattern of FIG. 5 is merely exemplary as one of ordinary skill may readily determine that numerous other shapes and configurations are possible. Accordingly, each "pedal" 214 of the flower shaped pattern of FIG. 5 corresponds to a potential pattern element, i.e. flower pedal, location 214. The pattern elements of FIG. 5 are shaped depressions into the exterior surface of the ink sticks. The identification patterns as depicted in FIG. 6 may be varied by providing the pattern elements in different locations and/or different numbers within the pattern from stick configuration to stick configuration.

As mentioned above, information pertaining to an ink stick or to the printer in which it is to be used may be associated with identification patterns by assigning a particular identification pattern to correspond to ink stick information such as the appropriate insertion opening for the ink stick, an alpha and/or numeric designation, such as a part number, SKU, or other unique identifier, the product model, printer platform or series that the ink is compatible with, etc. The ink stick data or information that is desired to be associated with a particular ink stick may then be embedded in the ink stick by selecting the appropriate identification pattern and forming the selected pattern in the pattern area of the ink stick.

The identification patterns incorporating pattern elements as described above enable unmagnified visual clarification of differences between sticks. While information embedded in a particular pattern may be determined by memorization of the various patterns and the associated information pertaining to each pattern, other methods of deciphering the visually discernible identification patterns may be utilized. For example, determining the information or unique identification associated with an identification pattern may be performed by comparison of an undetermined identification pattern with a matching representation of the pattern from, for example, an identification pattern from a known ink stick configuration, or by comparison of an undetermined identification pattern to a visual representation of the pattern that may be, for example, on a print out, an imaging screen, ink loader or product label, display panel, etc.

In one embodiment, visual representations of identification patterns may comprise pattern keys that display at least one identification pattern or a set of related identification patterns along with information associated with the patterns such as ink color, printer model, part number, SKU, etc. For example, FIG. 5 shows an embodiment of a pattern key 300 that may be used to facilitate visual interpretation of identification patterns incorporated into ink sticks such as the identification pattern 200 depicted on the ink stick 100*e* in FIG. 5. The pattern key 300 of FIG. 5 includes a plurality of the visual representations of the possible variations of the identification pattern of FIG. 5. As described above, the identification patterns of this embodiment include a plurality of potential pattern element locations 214. The identification patterns may be varied from pattern to pattern within the set by varying the number and/or placement of pattern elements 204 at the potential pattern locations 214. There are depicted six different pattern variations utilizing the six potential pattern element locations 214. Not all variation possibilities of a pattern need to be used or represented. Some pattern variations may be reserved for later use, for different purposes, or for different geographic regions, for example. As can be seen in FIG. 5, each pattern representation 224 in the pattern key, or chart, 300 includes associated information 228 pertaining to each pattern key part such as part number and printer model pertaining to each pattern. The pattern key, however, may include different or additional information such as appropriate load channel, print parameters for use with the stick, etc. The pattern key may also include information that aids in orienting the ink stick for visual inspection of the pattern. The pattern key of FIG. 5 is just one possible embodiment of a pattern key. A person of skill in the art may see that numerous variations and implementations of pattern keys for identifying patterns are possible. The pattern key of FIG. 5 may be a printed image, photo, fully or partially fabricated representation or collection of such physical forms, electronic graphic file, and/or may be displayed on an imaging screen or panel or other identification conveyance.

FIG. 6 shows another embodiment of how a set of ink sticks may be differentiated by a set of related identification patterns. In this embodiment, the pattern area 208 of ink stick 100f includes a plurality of potential element locations 230 within the pattern that are the substantially the same for each potential pattern. Similar to FIG. 5, the identification pattern 200 of FIG. 6 may be varied from pattern to pattern within a set of patterns by varying the potential locations 230 in each pattern that receive pattern elements 234 and/or the number of locations that receive pattern elements. In the embodiment of FIG. 5, the pattern 200 comprises a grid shape that includes a plurality of potential pattern element locations 230, in this case eight, that are arranged in a grid like pattern of four columns of two potential pattern element locations 230. The flower pattern of FIG. 5 is merely exemplary as one of ordinary skill may readily determine that the grid may have any suitable number of locations, the locations need not be arranged linearly and may be fully or partially offset in more than one direction. The pattern elements 204 of FIG. 5 may be depressions, and/or protrusions or other visible features, such as significant texture, and have any suitable shape including circles, squares, triangles, etc. The identification pattern 200 as depicted in FIG. 6 may be varied by providing the pattern elements 204 in different locations and/or different numbers within the pattern 200 from stick configuration to stick configuration.

FIG. 6 also shows an embodiment of a pattern key 400 that may be used to facilitate visual interpretation of identification patterns 200 incorporated into ink sticks such as the identification pattern 200 depicted on the ink stick 100*f* in FIG. 6. The pattern key 400 of FIG. 6 includes a plurality of the visual representations of the possible variations of the identification pattern of FIG. 5. There are depicted twenty different pattern variations 238 utilizing the eight potential pattern element locations 230. As mentioned, not all variation possibilities of a pattern need to be used or represented. As can be seen in FIG. 6, each pattern representation in the pattern key includes associated information pertaining to each pattern key such as color, model, and SKU pertaining to the respective pattern. The pattern key, however, may include different or additional information such as appropriate load channel, print parameters for use with the stick, etc. The pattern key may also include information that aids in orienting the ink stick for visual inspection of the pattern. The pattern key of FIG. 6 is just one possible embodiment of a pattern key. A person of skill in the art may see that numerous variations and implementations of pattern keys for identifying patterns are possible. The pattern key of FIG. 6 may be a printed image, photo, physical form, electronic graphic file, and/or may be displayed on an imaging screen or panel or other suitable information conveyance.

Figure 7A:
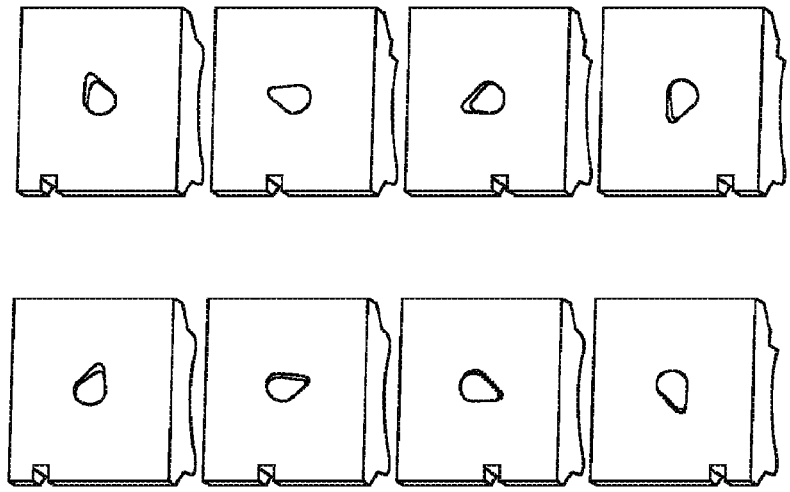
FIG. 7*a* shows an embodiment of a visual pattern with an angled inset bottom that is rotated relative to the ink stick body to different orientations in each stick of two ink stick sets.
Figure 7B:
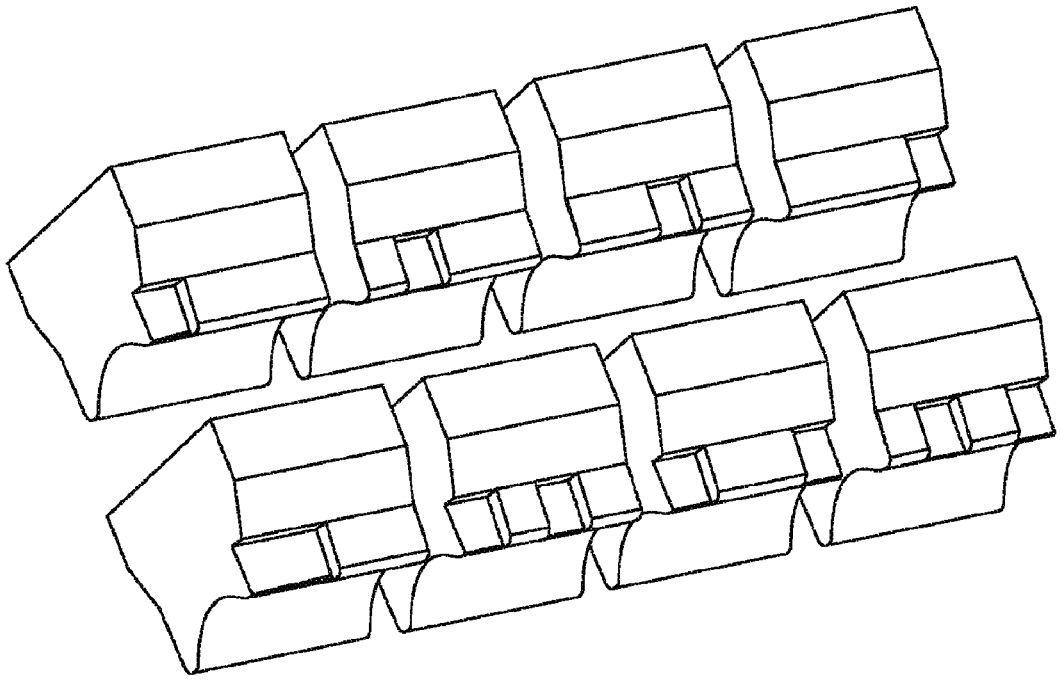
FIG. 7*b* is yet another variation of a visual pattern of inset areas for two ink stick sets.

FIG. 7*a* shows another example of a visual pattern, this time with an angled inset bottom that is rotated relative to the ink stick body to different orientations in each stick of two ink stick sets. FIG. 7*b* is yet another variation of a visual pattern of inset areas for two ink stick sets. In this case, one or more inset of approximately equal size is used to convey identification distinction. As depicted, the pattern includes a single element in various locations and multiple elements that may be adjacent or separated. Another variation of this same pattern (not shown) would be use of three or all four elements, the latter in this case would appear as a full width inset. Two or more insets may appear as a larger continuous feature by being adjacent or overlapping since a pattern does not require isolation or separation of the elements. Reference interpretation aids for these examples are not shown but may be similar to the 5*b* and 6*b* examples. Visual pattern elements may serve additional functions, as example, when installed in a printer such features may be used for sensing stick identification.

As an alternative to using a visual representation of the identification patterns and using a visual comparison between an unidentified pattern and the representation to determine the information associated with the pattern, identification patterns may be identified and the associated information determined using an electronic scanning device or sensor apparatus capable of determining which identification pattern is present on an ink stick from a range of programmed patterns. Such an apparatus may be a portable unit, may be built into stationary inventory control equipment or may be incorporated into the imaging device itself or one of its components or assemblies such as a document scanner.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A solid ink stick comprising:

an ink stick body formed of a phase change ink material, the ink stick body being configured for inclusion in a first set of ink sticks and having substantially a same size and shape as other ink sticks in the first set of ink sticks and the same size and shape as ink sticks in a second set of ink sticks, the first set of ink sticks being configured for insertion into a first model of printer that excludes the ink sticks of the second set of ink sticks and the second set of ink sticks being configured for insertion into a second model of printer that excludes the ink sticks of the first set of ink sticks; and an identification pattern formed on the ink stick body, the identification pattern being one identification pattern in a set of identification patterns, the identification pattern formed on the ink stick body being visually discernible from the other identification patterns in the set of identification patterns and configured with both protrusions and depressions in a surface of the ink stick body to differentiate the ink stick from the other ink sticks in the first set of ink sticks and to differentiate the ink stick from the ink sticks in the second set of ink sticks.

2. The ink stick of claim 1, the identification pattern formed on the ink stick body being assigned to correspond to an ink stick identifier pertaining to the ink stick body.

3. The ink stick of claim 2, the ink stick identifier being assigned to indicate at least one of a color of ink, printer model, part number, and stock keeping unit (SKU) for the ink stick body.

4. The ink stick of claim 1, the ink stick body including one or more pattern areas, the identification pattern being formed in the one or more pattern areas, the one or more pattern areas on the ink stick body being in substantially the same position as pattern areas on the other ink sticks of the first set of ink sticks and as pattern areas on the ink sticks of the second set of ink sticks.

5. The ink stick of claim 1, the identification pattern formed on the ink stick body further comprising:

at least one pattern element, the at least one pattern element having at least one characteristic that is visually discernible from pattern elements of the other identification patterns in the set of identification patterns.

6. The ink stick of claim 1, the at least one characteristic being selected from a size, shape, and position of at least one pattern element within the identification pattern.

7. A plurality of ink sticks comprising:

a first set of ink sticks configured for use in a first printer model;

a second set of ink sticks configured for use in a second printer model;

each ink stick in the first set of ink sticks and each ink stick in the second set of ink sticks being substantially a same size and shape, each ink stick in the first set of ink sticks and each ink stick in the second set of ink sticks including at least one pattern area, the pattern area being in a same position on each ink stick in the first set of ink sticks and each ink stick in the second set of ink sticks; and each ink stick in the first set of ink sticks and each ink stick in the second set of ink sticks having an identification pattern formed in the at least one pattern area of the ink stick, each identification pattern comprising a variation of a pattern in a set of identification patterns that enables each identification pattern in the set of identification patterns to be visually discernible from the other identification patterns in the set of identification patterns, each ink stick in the first set of ink sticks having an identification pattern in the set of identification patterns that enable each ink stick in the first set of ink sticks to be differentiated from the other ink sticks in the first set of ink sticks and to be differentiated from the ink sticks in the second set of ink sticks and each ink stick in the second set of ink sticks having an identification pattern in the set of identification patterns that enable each ink stick in the second set of ink sticks to be differentiated from the other ink sticks in the second set of ink sticks and to be differentiated from the ink sticks in the first set of ink sticks, the identification pattern for each ink stick in the first set of ink sticks and the second set of ink sticks being formed in the pattern area of each ink stick with both protrusions and depressions.

8. The plurality of ink sticks of claim 7, each identification pattern in the plurality being assigned to represent an ink stick identifier.

9. The plurality of ink sticks of claim 8, each ink stick identifier being assigned to indicate at least one of a color of ink, printer model, part number, and stock keeping unit (SKU) of the ink stick upon which it is formed.

10. The plurality of ink sticks of claim 7 , each identification pattern in the set having at least one pattern element having at least one characteristic that is visually discernible from the pattern elements of the other identification patterns in the set of identification patterns.

11. The plurality of ink sticks of claim 10, the at least one characteristic being at least one of size, shape, and position of the at least one pattern element within the pattern.

12. A system for identifying ink sticks comprising:

a first set of ink sticks configured for use in a first printer model;

a second set of ink sticks configured for use in a second printer model;

each ink stick in the first set of ink sticks and each ink stick in the second set of ink sticks being substantially a same size and shape, each ink stick in the first set of ink sticks and each ink stick in the second set of ink sticks having an identification pattern formed thereon, each identification pattern formed on an ink stick comprising both protrusions and depressions in a surface of the ink stick body to form a variation of a pattern in a set of identification patterns that enables each identification pattern in the set of identification patterns to be visually discernible from the other identification patterns in the set of identification patterns, each ink stick in the first set of ink sticks having an identification pattern in the set of identification patterns that enable each ink stick in the first set of ink sticks to be differentiated from the other ink sticks in the first set of ink sticks and to be differentiated from the ink sticks in the second set of ink sticks and each ink stick in the second set of ink sticks having an identification pattern in the set of identification patterns that enable each ink stick in the second set of ink sticks to be differentiated from the other ink sticks in the second set of ink sticks and to be differentiated from the ink sticks in the first set of ink sticks; and a set of matching representations, each matching representation corresponding to one of the identification patterns formed on the ink sticks of the first and second sets of ink sticks, each matching representation including information associated with the identification pattern corresponding to the matching representation.

13. The system of claim 12, the information associated with each identification pattern comprising at least one of a color of ink, printer model, part number, and stock keeping unit (SKU).

14. The system of claim 13, the matching representation of each identification pattern being incorporated into at least one of a sheet of media, a label and a display panel.

* * * * *